United States Patent [19]

Miyasaka et al.

[11] 4,237,440

[45] Dec. 2, 1980

[54] GLASS-TUBE FUSE

[75] Inventors: Susumu Miyasaka; Isamu Miyasaka, both of Yokosuka, Japan

[73] Assignee: Kowa Denki Kogyo Kabushiki Kaisha, Lamagawa, Japan

[21] Appl. No.: 931,917

[22] Filed: Aug. 8, 1978

[30] Foreign Application Priority Data

Aug. 9, 1977 [JP] Japan ..... 52-95315

[51] Int. Cl.[3] ..... H01H 85/14

[52] U.S. Cl. ..... 337/227; 337/233; 337/290

[58] Field of Search ..... 337/159, 290, 291, 293, 337/295, 296, 227, 228, 231, 233, 241

[56] References Cited

U.S. PATENT DOCUMENTS

| | | | |
|---|---|---|---|
| 1,579,596 | 4/1926 | Cote | 337/290 |
| 3,825,870 | 7/1974 | Ono et al. | 337/295 X |

*Primary Examiner*—George Harris

*Attorney, Agent, or Firm*—Robert E. Burns; Emmanuel J. Lobato; Bruce L. Adams

[57] ABSTRACT

In a glass-tube fuse comprising a glass tube, conductive caps on opposite ends of the tube and a fuse element enclosed in the tube and connected between the caps, the fuse element comprises a plurality of cores extending between the caps and at least one braiding strand of metallic material coiled alternately around the cores in opposite directions and connected at its ends to the end caps.

7 Claims, 3 Drawing Figures

GLASS-TUBE FUSE

BACKGROUND OF THE INVENTION

This invention relates glass-tube fuses, and more particularly to the fuse element in a glass-tube fuse, which is fused upon application of over-current.

Essential ones of the characteristics required for a fuse are a fusing characteristic required when overloaded, an interrupting characteristic required when over-current such as a short-circuit flows, and a surge characteristic against a surge which may caused by opening or closing a line for instance.

There have been proposed a variety of fuses, which intend to improve a particular one of these characteristics. Referring only to the fuse elements, heretofore a fuse element made by twisting a plurality of strands instead of a single strand or a fuse element made by winding a metal wire around one or more cores are proposed.

However, glass-tube fuses which have the abovedescribed characteristics, and are stable in characteristic, and which can be readily manufactured have not yet been provided.

SUMMARY OF THE INVENTION

Accordingly, an object of this invention is to provide a glass-tube fuse which is excellent and stable in characteristic and can be readily manufactured at low cost.

The foregoing object and other objects of the invention have been achieved by the provision of a glass-tube fuse comprising a glass tube and electrically conductive caps provided on both ends of the glass tube, which fuse comprises a fuse element made of a braided wire which is inserted into the glass tube and comprises a plurality of cores extending between the caps, and at least one braiding strand of metallic material coiled alternately around the cores and connected at its ends to caps.

The nature, principle and utility of the invention will become more apparent from the following detailed description and the appended claim when read in conjunction with the accompanying drawings.

DETAILED DESCRIPTION OF THE INVENTION

Figure 1:
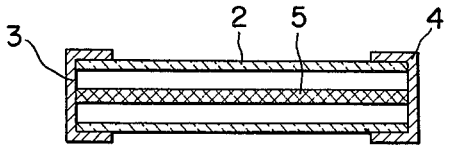
FIG. 1 a longitudinal sectional view showing one example of a glass-tube fuse according to this invention.

One example of a glass-tube fuse according to this invention, as shown in FIG. 1, comprises a cylindrical glass tube 2, electrically conductive caps 3 and 4 provided on both ends of the glass tube, and a fuse element 5 connected between the conductive caps 3 and 4 and inside the glass tube 2.

The specific feature of the fuse according to the invention resides in the fuse element 5. More specifically, unlike the conventional fuse elements which are in the form of a single wire, a stranded wire, or a wound wire, the fuse element 5 is in the form of a braided wire based on a completely novel technical concept. A typical example of the fuse element 5 is shown in FIGS. 2 and 3.

Figure 2:
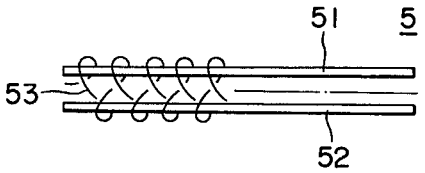
FIGS. 2 and 3 are explanatory diagrams for a description of the construction of a fuse element shown in FIG. 1.
Figure 3:
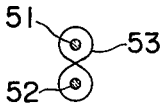

FIGS. 2 and 3 schematically show the fuse element 5 which comprises two cores 51 and 52 made of insulating material or metalic material, and a brading strand 53 made of metallic material, which is coiled alternately around the two cores 51 and 52 in the form of the figure "8". The numbers of cores and braiding strands, and the braiding pattern of the fuse element according to the invention are not limited to those shown in FIGS. 2 and 3. That is, the fuse element may be braided according to other various methods which are well known in the art of braided wires. A fuse element such as described above can be industrially manufactured relatively readily at low cost because of the recent development of braid wire manufacturing technology.

Over-current tests were given to fuses of various types by allowing a current 1.6 times as high as the rated current to flow in each of the fuses, and the results are as follows: In most of the conventional fuses each employing a single wire or a stranded wire as its fuse element, the fuse element slackened to stick on the inner wall of the glass tube, as a result it was difficult to show its predetermined blowing characteristics. On the other hand, with the fuse according to the invention, such serious deformation was not caused, and its predetermined blowing characteristics were ensured with accuracy.

As for the anti-surge characteristic, since the strand more than twice as long as the strand of the conventional fuse element, for instance, in the form of a wound wire can be incorporated inside the glass tube of the fuse according to the invention under the condition that the glass tubes of the conventional fuse and the present invention are equal to each other, the fuse according to the invention is superior to the conventional fuses in surge characteristic also.

In general, when current flows in a fuse wire, the Joule heat is generated in it to increase the temperature thereof. When the current is increased larger than a certain value, the Joule heat is also increased higher than the melting point of the fuse wire, as a result of which the fuse wire is blown. The fusing time is dependent on the thermal capacity of a fuse wire. That is, the larger the thermal capacity, the longer the fusing time. Accordingly, in order to increase the fusing time, it is necessary to use a fuse wire whose thermal capacity is larger, that is, it is required to use a fuse wire whose diameter is larger.

However, if the diameter of a fuse wire is increased, then the resistance thereof is decreased as much. Accordingly, in order to obtain the same current capacity, the length of the fuse wire should be increased to increase the resistance thereof.

Accordingly, in order to give a fuse wire an antisurge characteristic that the fuse wire is not blown with a surge current (or over-current for a short time), it is necessary to increase the length and diameter of the fuse wire. In this case, as the length and diameter of the fuse wire are increased, the surge resistance characteristic thereof becomes high.

Furthermore, in the case of the fuse element in the form of a braided wire, it is possible to obtain a predetermined current capacity by braiding it with a number of strands. Therefore, it is possible to select the number of strands and the material of strand, as desired, over a wide range. Thus, the fuse element in the form of a braided wire has a merit that a variety of fusing characteristics as in quick-acting fuses and time-lag fuses can be readily obtained.

In braiding a braided wire with strands, as the number of strands is increased, the total length of strands is increased and the resistance of the braided wire is increased. Therefore, when the over-current is allowed to flow in the braided wire, the latter is quickly fused as the quantity of heat generated therein is increased because of the increased resistance.

When the over-current flows in the melting element of a fuse, the temperatures of both end portions of the melting element are relatively low because they are connected to the caps provided at the two ends of the fuse where the heat is radiated. However, the heat generated in the middle portion of the melting element is scarcely radiated, and accordingly the temperature thereof is raised higher than at the two end portions thereof, and finally the melting element is fused.

On the other hand, in the case when over-current flows in a braided wire, the quantities of heat generated in the strands affect one another, as a result of which the temperature of the braided wire is abruptly increased, so that the braided wire is fused. Accordingly, in the case of the braided wire, as the number of strands is increased, the element resistance is increased and the temperature is also increased quickly. Thus, the quick-acting characteristic can be obtained.

The current 1.3 times as high as the rated current was continuously applied to the conventional fuse and to the fuse according to the invention, for comparison. The temperature of the conventional fuse was increased as much as 70° C., while it was ensured that the temperature rise range of the fuse according to the invention was reduced to an extent of 50°C. -60° C. Furthermore, based on the construction of the fuse described above, the braiding strand 53 was made of a melting wire and was coiled on glass wires. In this case, it was confirmed that the temperature rise could be reduced to 50° C. or lower when the current 1.3 times of the rated current was applied to the fuse. The glass cores employed together with the melting wire may be of a selected colored. The employment of the colored glass cores is advantageous in that the rated current values of fuses or various marks utilized in manufacturing fuses can be indicated by the colors of glass cores, thereby to improve work efficiency and to eliminate errors in actual operation.

In addition, it is readily achieved to make the fuse element in the form of a braided wire relatively highly flexible. Accordingly, the fuse element according to the invention can be readily handled. Therefore, if the fuse element according to the invention is employed for manufacturing fuses, it is possible to considerably increase work efficiency and to eliminate the problem that the element is broken during the manufacture of fuses.

We claim:

1. A glass-tube fuse comprising a glass tube, electrically conductive caps on both ends of the glass tube and a fuse element which is enclosed in said glass tube and connected between said caps, said fuse element being braided wire comprising a plurality of cores extending between said caps and at least one braiding strand of metallic material coiled alternately around said cores and connected at its ends to said caps.

2. A glass-tube fuse according to claim 1, in which said cores are insulating material.

3. A glass-tube fuse according to claim 2, in which said cores are of glass.

4. A glass-tube fuse according to claim 3, in which said glass cores are color coded to designate rated current value of the fuse.

5. A glass-tube fuse according to claim 1, in which there are two of said cores and in which said braiding strand is coiled alternately around said two cores in opposite directions in the form of a figure "8".

6. A glass-tube according to claim 1, in which the length of the braiding strand is more than twice the length of the core wires.

7. A glass-tube fuse according to claim 1, in which a plurality of said braiding strands are coiled alternately around said cores.

* * * * *